US006519795B1

(12) United States Patent
Liu

(10) Patent No.: US 6,519,795 B1
(45) Date of Patent: Feb. 18, 2003

(54) NURSING BED

(75) Inventor: Da Dun Liu, Taipei (TW)

(73) Assignee: Tung Tai Chuang Co., Ltd., Taipei (TW)

( * ) Notice: Subject to any disclaimer, the term of this patent is extended or adjusted under 35 U.S.C. 154(b) by 0 days.

(21) Appl. No.: 10/002,308

(22) Filed: Nov. 14, 2001

(51) Int. Cl.[7] ..... A61G 7/00
(52) U.S. Cl. ..... 5/617; 5/602
(58) Field of Search ..... 217/423.1, 423.12; 5/602, 604, 617, 618, 624, 185

(56) References Cited

U.S. PATENT DOCUMENTS 5,134,737 A * 8/1992 Wyman ..... 5/185
5,806,114 A * 9/1998 Morgan et al. ..... 5/602
6,408,464 B1 * 6/2002 Weismiller et al. ..... 5/602

* cited by examiner

*Primary Examiner*—Lynne H. Browne
*Assistant Examiner*—Fredrick Conley
(74) *Attorney, Agent, or Firm*—Pro-Techtor International Services

(57) ABSTRACT

A nursing bed has a lifting device mounted on the front frame so that the patient is still able to change the upper part of the body and a sliding device mounted between the mediate frame and the rear frame so that the rear frame is able to move sidewardly relative to the mediate frame of the nursing bed.

3 Claims, 9 Drawing Sheets

NURSING BED

BACKGROUND OF THE INVENTION

1. Field of the Invention

The present invention relates to a nursing bed, and more particularly to a nursing bed, which has a front frame, a mediate frame and a rear frame. The front end of the front frame and the rear end of the rear frame respectively have two supports each with a roller mounted at a free end of the support and a brake element. A sliding member is mounted between the mediate frame and the rear frame so that the rear frame is able to move traversely relative to the mediate frame.

2. Description of Related Art

With reference to FIG. 1, a conventional nursing bed (100) is shown and has a lifting mechanism mounted on the front frame so that the patient is able to lift the upper part of the body for eating or reading. As for the rear frame, a similar lifting mechanism is also mounted for the patient to change the position of the legs. However, these lifting mechanism requires a lot of gearing equipment and motors to activate, which is too costy and inconvenient for operation. Because this lifting mechanism needs another person to operate the mechanism and the lifting mechanism only changes the position of the legs of the patient in longitudinal direction, there is no way that the patient has a chance to work his/her legs in a latitudinal direction relative to the bed. Besides, every operation of the lifting mechanism requires the alternation of the entire structure of the nursing bed, which is too much time consuming and labor inefficient.

To overcome the shortcomings, the present invention intends to provide an improved nursing bed to mitigate or obviate the aforementioned problems.

SUMMARY OF THE INVENTION

The primary objective of the invention is to provide a nursing bed which is able to allow the patient to work the legs in the latitudinal direction relative to the bed.

In order to achieve the foregoing objective, the nursing bed of the present invention has a lifting device mounted on the front frame so that the patient is still able to change the upper part of the body and a sliding device mounted between the mediate frame and the rear frame so that the rear frame is able to move sidewardly relative to the mediate frame.

Other objects, advantages and novel features of the invention will become more apparent from the following detailed description when taken in conjunction with the accompanying drawings.

DETAILED DESCRIPTION OF PREFERRED EMBODIMENT

Figure 1:
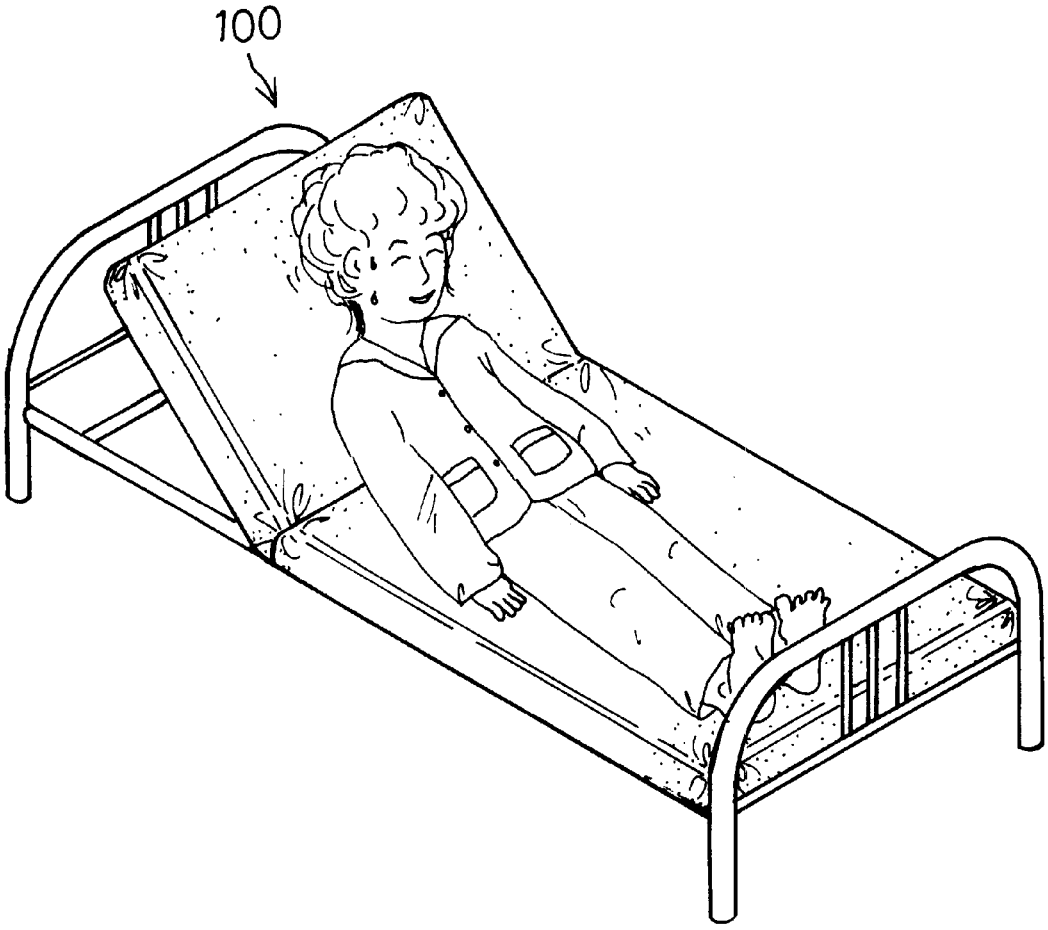
PRIOR ART Fig. 1
FIG. 1 is a perspective view of a conventional nursing bed, wherein the patient lying on the bed can only change his/her upper body.
Figure 2:
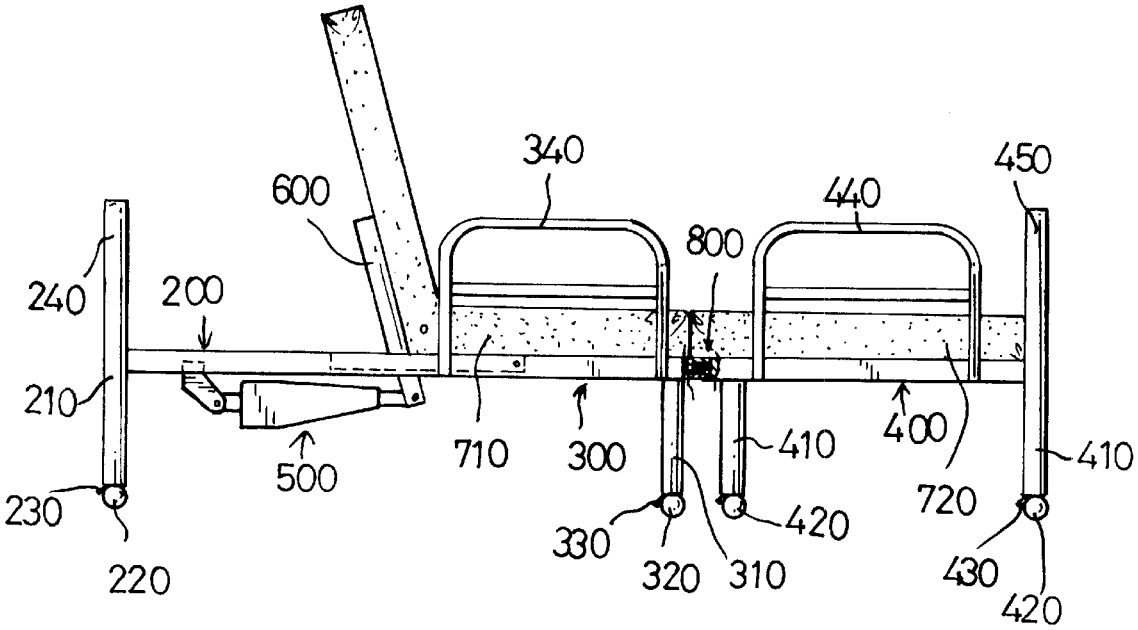
FIG. 2 is a side view of the nursing bed of the present invention.

With reference to FIG. 2, a nursing bed in accordance with the present invention has a front frame (200), a mediate frame (300) and a rear frame (400). The front end of the front frame (200) has two supports (210) and the rear end of the mediate frame (300) has two supports (310). The front and rear ends of the rear frame (400) have two supports (410) respectively. Each of the distal end of the supports (210, 310,410) has a roller (220,320,420) and a brake (230,330, 430) so that the nursing bed of the present invention is able to be moved and controlled freely. A lifting cylinder (500) is mounted underside the front frame (200) and is connected to a moving board (600) so that the moving board (600) is able to be controlled to pivot by the lifting cylinder (500) to the mediate board (710) mounted on the mediate frame (300). A sliding device (800) is mounted between the mediate frame (300) and the rear frame (400) so that the rear frame (400) is able to move relative to the mediate frame (300). Furthermore, side faces of the mediate and rear frames (300,400) have guarding fences (340,440) to prevent the patient on the bed from rolling down the bed. The guarding fences (340,440) are conventional so that detailed description thereof is omitted hereinafter. A fix fence (240,450) is respectively mounted on a free end of the front frame (200) and rear frame (400). A rear board (720) is mounted on the rear frame (400).

Figure 3A:
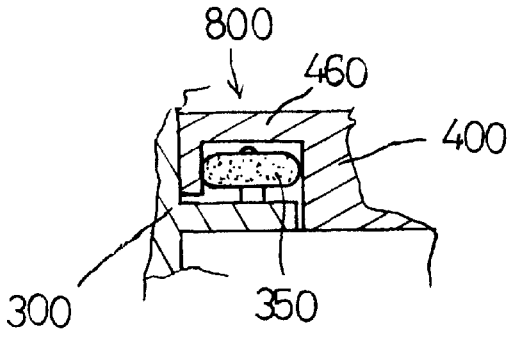
FIG. 3A is a cross sectional view of a sliding device of the first preferred embodiment of the present invention.

With reference to FIG. 3A, a first preferred embodiment of the sliding device (800) of the present invention is mounted between the mediate frame (300) and the rear frame (400). The mediate frame (300) has a rolling wheel (350) rotatably mounted on an L shaped frame of the mediate frame (300) and a U shaped frame (460) of the rear frame (400). The rolling wheel (350) has a rotation axis vertical to the bed.

Figure 3B:
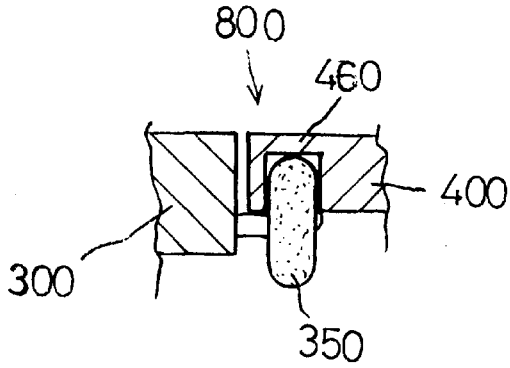
FIG. 3B is a cross sectional view of a sliding device of the second preferred embodiment of the present invention.

With reference to FIG. 3B, a second preferred embodiment of the sliding device (800) of the present invention is mounted between the mediate frame (300) and the rear frame (400). The mediate frame (300) has a rolling wheel (350) rotatably mounted on an L shaped frame of the mediate frame (300) and a U shaped frame (460) of the rear frame (400). The rolling wheel (350) has a rotation axis horizontal to the bed.

Figure 3C:
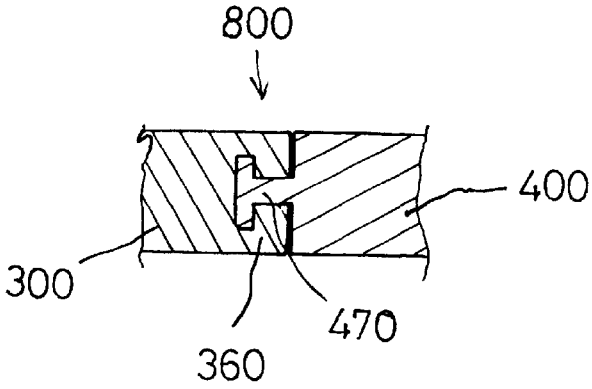
FIG. 3C is a cross sectional view of a sliding device of the third preferred embodiment of the present invention.
Figure 4:
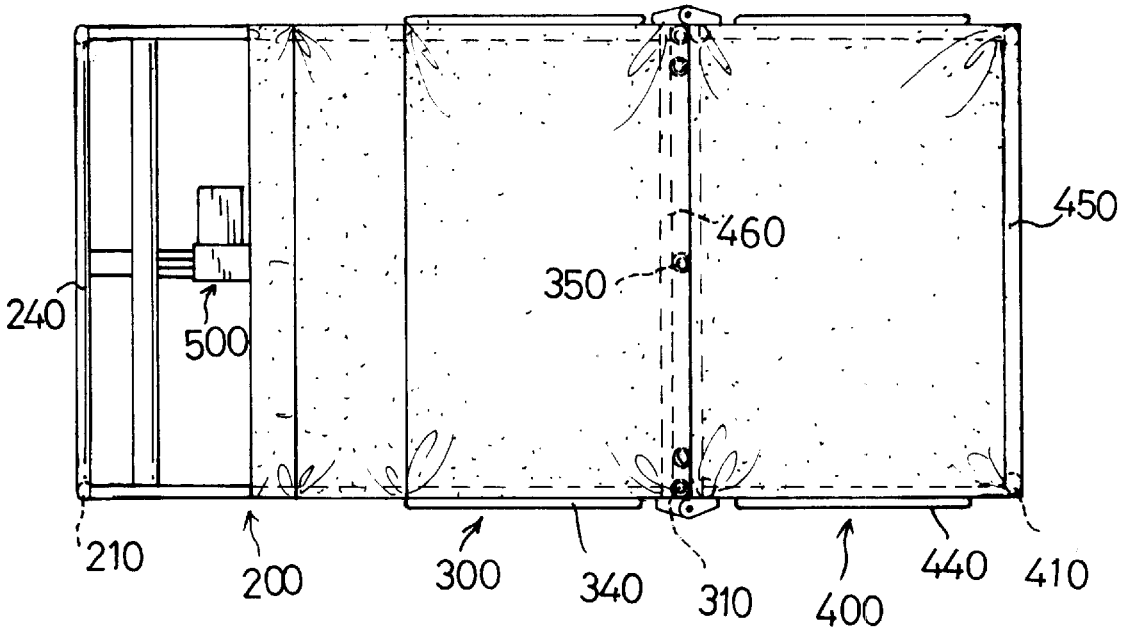
FIG. 4 is a top plan view of the sliding device of FIGS. 3A and 3B.
Figure 5:
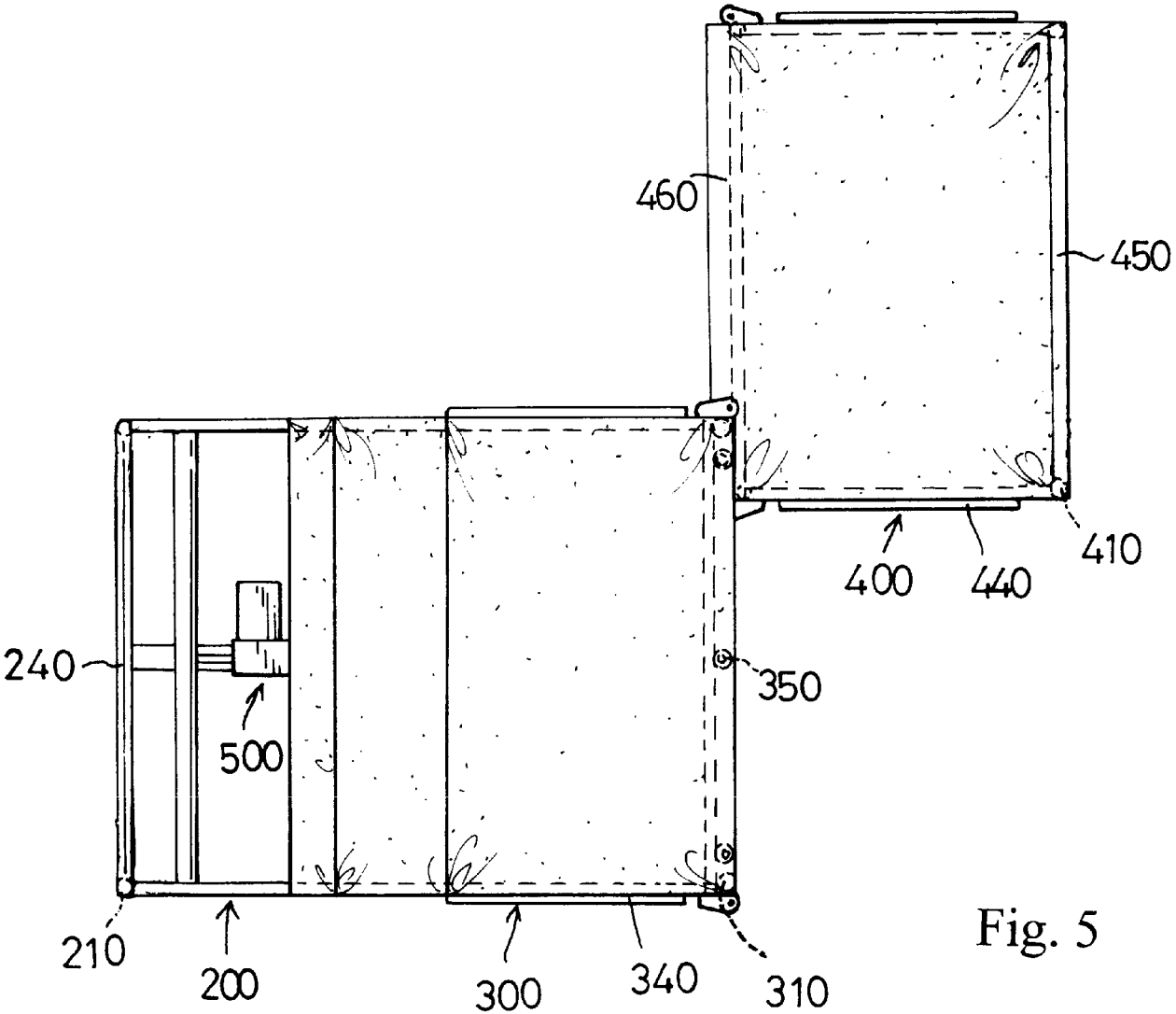
FIG. 5 is an operational top plan view of the sliding device of FIGS. 3A and 3B.
Figure 6:
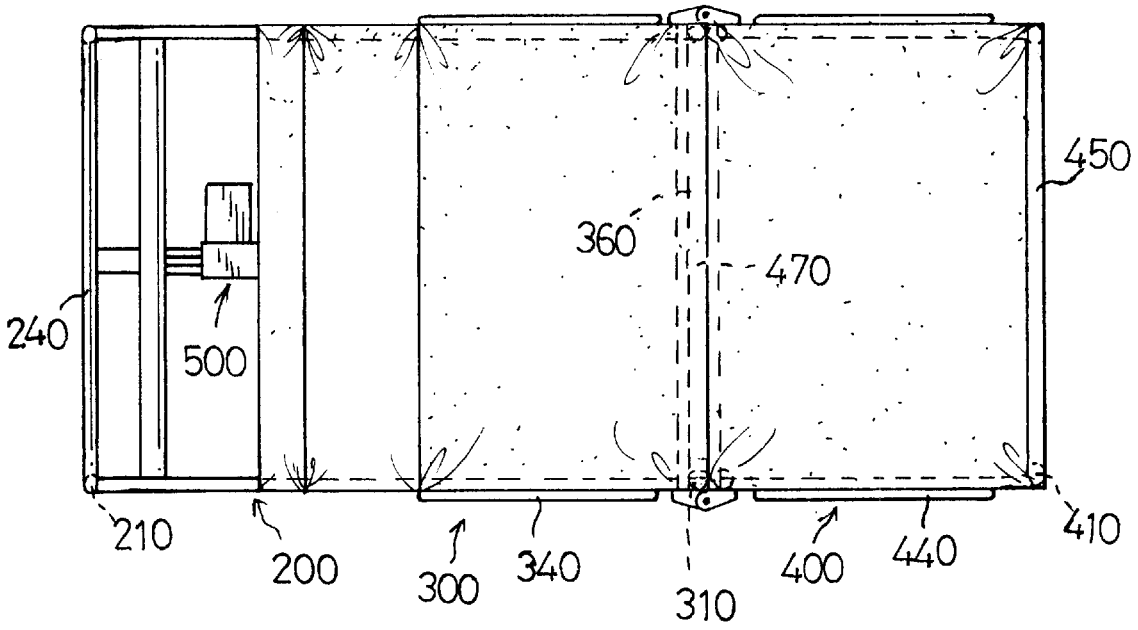
FIG. 6 is a top plan view of the sliding device of FIG. 3C.
Figure 7:
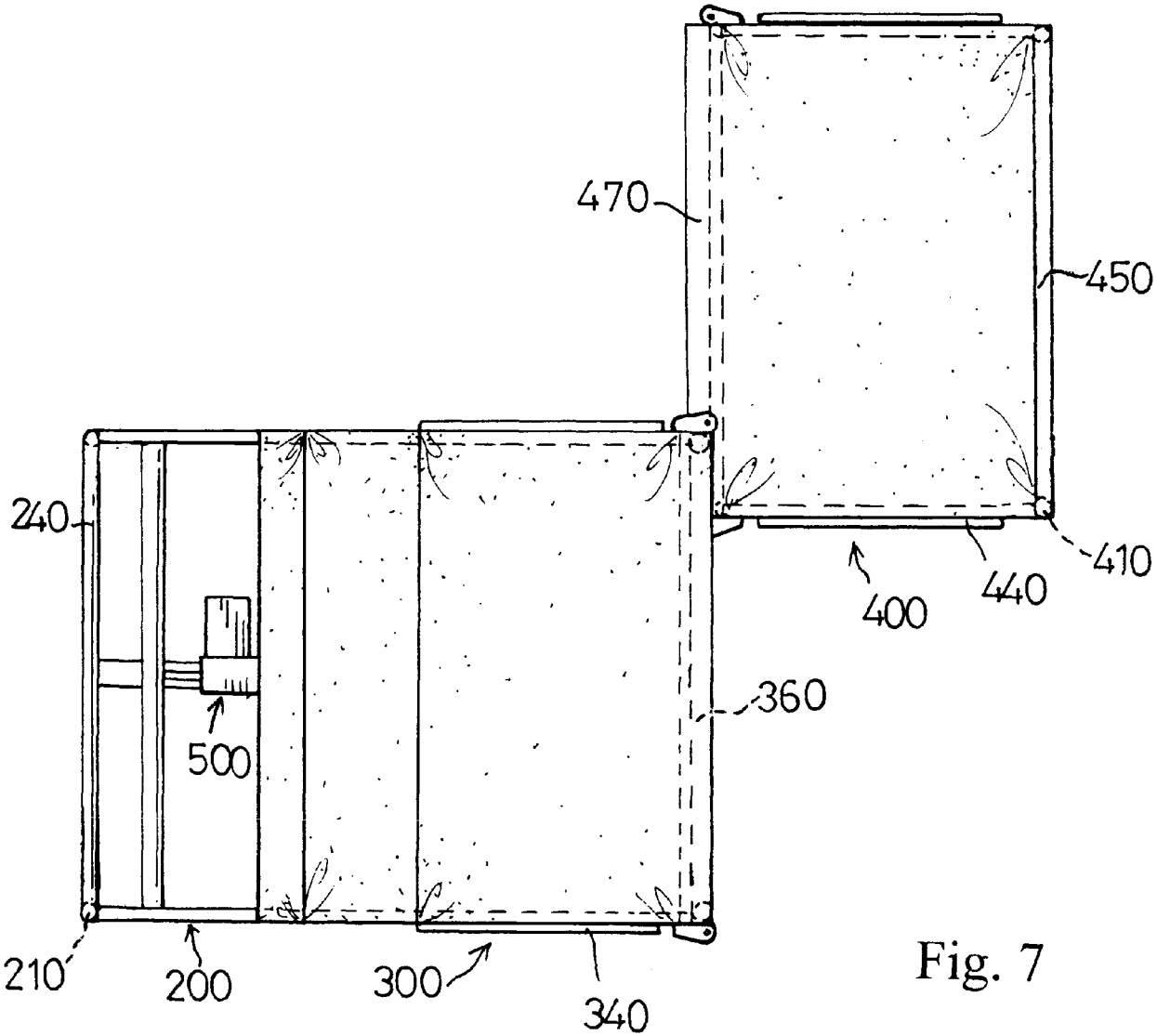
FIG. 7 is an operational top plan view of the sliding device of FIG. 6.

With reference to FIG. 3C, the sliding device (800) includes a U shaped recess (360) defined in the mediate frame (300) and a T shaped extension (470) corresponding O the U shaped recess (360) so that the rear frame (400) is able to slide with respect to the mediate frame (300).

Figure 8:
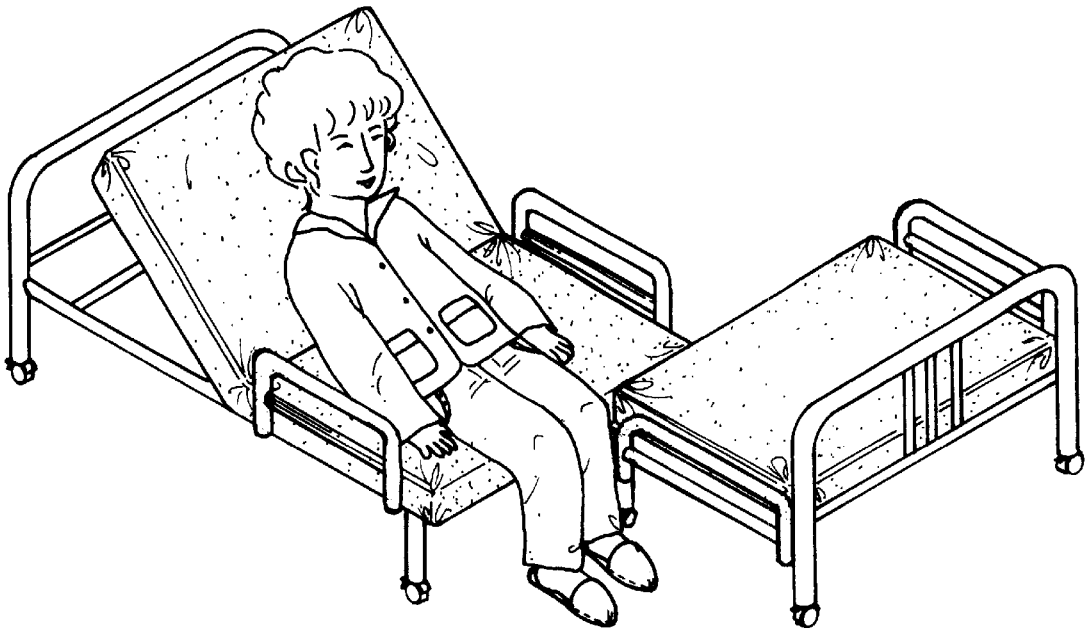
FIGS. 8 and 9 are operational views showing the patient is able to change to any position without leaving the bed or further changing the structure of the nursing bed of the present invention.
Figure 9:
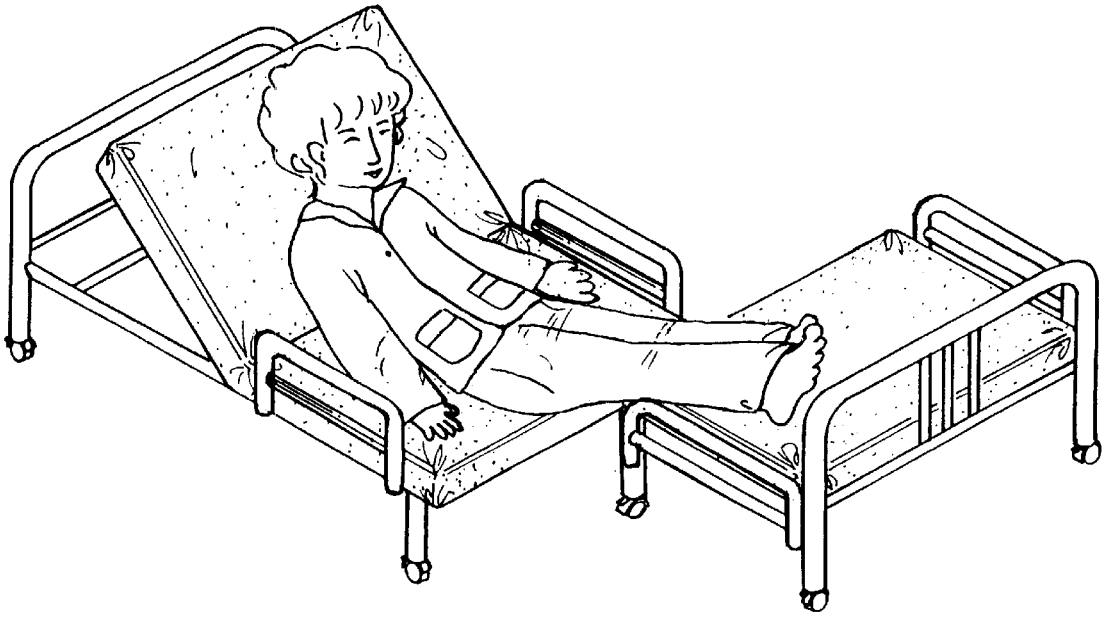

With reference to FIGS. 4, 5, 6 and 7, there are three rolling wheels (350) in the sliding device (800) so that when the rear frame (400) is moving sidewardly with respect to the mediate frame (300), the movement is smooth. Due to the corresponding between the U shaped recess (360) and the T shaped extension (470), the rear frame (400) has a horizontal movement to the mediate frame (400). Therefore, with reference to FIG. 8 and FIG. 9, there is no need to change the structure of the nursing bed of the present invention to allow the patient to change from lying to sitting up positions.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A nursing bed comprising a front frame, a mediate frame and a rear frame; wherein the front end of the front frame has two supports and the rear end of the mediate frame has two supports, the front and rear ends of the rear frame have two supports respectively, each of the distal end of the supports has a roller and a brake so that the nursing bed of the present invention is able to be moved and controlled freely, a lifting cylinder is mounted underside the front frame and is connected to a moving board mounted on the front frame so that the moving board is able to be controlled to pivot by the lifting cylinder to a mediate board mounted on the mediate frame, characterized in that a sliding device mounted between the mediate frame and the rear frame so that the rear frame is able to move relative to the mediate frame, wherein the sliding device has a rolling wheel rotatably mounted on an L shaped frame of the mediate frame and a U shaped frame of the rear frame, wherein the rolling wheel has a rotation axis vertical to the bed.

2. A nursing bed comprising a front frame, a mediate frame and a rear frame, wherein the front end of the front frame has two supports and the rear end of the mediate frame has two supports, the front and rear ends of the rear frame have two supports respectively, each of the distal end of the supports has a roller and a brake so that the nursing bed of the present invention is able to be moved and controlled freely, a lifting cylinder is mounted underside the front frame and is connected to a moving board mounted on the front frame so that the moving board is able to be controlled to pivot by the lifting cylinder to a mediate board mounted on the mediate frame, characterized in that a sliding device mounted between the mediate frame and the rear frame so that the rear frame is able to move relative to the mediate frame, wherein the sliding device has a rolling wheel rotatably mounted on an L shaped frame of the mediate frame and a U shaped frame of the rear frame, wherein the rolling wheel has a rotation axis horizontal to the bed.

3. A nursing bed comprising a front frame, a mediate frame and a rear frame, wherein the front end of the front frame has two supports and the rear end of the mediate frame has two supports, the front and rear ends of the rear frame have two supports respectively, each of the distal end of the supports has a roller and a brake so that the nursing bed of the present invention is able to be moved and controlled freely, a lifting cylinder is mounted underside the front frame and is connected to a moving board mounted on the front frame so that the moving board is able to be controlled to pivot by the lifting cylinder to a mediate board mounted on the mediate frame, characterized. in that a sliding device mounted between the mediate frame and the rear frame so that the rear frame is able to move relative to the mediate frame, wherein the sliding device has a U shaped recess in the mediate frame and a T shaped extension corresponding to the U shaped recess and being in the rear frame.

* * * * *